US007565096B2

(12) United States Patent
Murayama

(10) Patent No.: US 7,565,096 B2
(45) Date of Patent: Jul. 21, 2009

(54) IMAGE FORMING APPARATUS AND IMAGE CARRIER UNIT

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 37 days.

(21) Appl. No.: 11/679,534

(22) Filed: Feb. 27, 2007

(65) Prior Publication Data

US 2007/0201902 A1 Aug. 30, 2007

(30) Foreign Application Priority Data

Feb. 27, 2006 (JP) ..... 2006-050366

(51) Int. Cl.
*G03G 15/00* (2006.01)
*G03G 21/18* (2006.01)

(52) U.S. Cl. ..... 399/167; 399/112

(58) Field of Classification Search ..... 399/110, 399/112, 167
See application file for complete search history.

(56) References Cited

U.S. PATENT DOCUMENTS 6,708,011 B2 3/2004 Nomura et al.
6,708,013 B2 * 3/2004 Nomura ..... 399/167
6,771,919 B2 8/2004 Koide
6,868,244 B2 3/2005 Koide
7,031,642 B2 * 4/2006 Abe ..... 399/167
2003/0053819 A1 3/2003 Nomura et al.

FOREIGN PATENT DOCUMENTS

| | | |
|---|---|---|
| JP | 8194361 | 7/1996 |
| JP | 2001147565 | 5/2001 |
| JP | 2001281959 | 10/2001 |
| JP | 2003015378 | 1/2003 |
| JP | 2003029483 | 1/2003 |
| JP | 2004246185 | 9/2004 |

* cited by examiner

*Primary Examiner*—Sandra L Brase
(74) *Attorney, Agent, or Firm*—Banner & Witcoff, Ltd.

(57) ABSTRACT

An image forming apparatus includes an image carrier unit, a unit containing portion, driving units, driving sources, and a phase change matching unit. The image carrier unit integrally has image carriers that respectively carry images, and respectively have rotational shafts. The unit containing portion removably contains the image carrier unit. Each of the driving units includes at least one driving gear, and transmits driving force by the driving gear to the rotational shaft of one of the image carriers that corresponds thereto. The driving sources apply the driving force to the driving gears of the driving units. The phase change matching unit matches phase changes in the driving gears of the driving units when no image is formed.

14 Claims, 10 Drawing Sheets

FIG.8

IMAGE FORMING APPARATUS AND IMAGE CARRIER UNIT

CROSS-REFERENCE TO RELATED APPLICATIONS

This application claims the benefit of Japanese Patent Application No. 2006-50366 filed Feb. 27, 2006 in the Japan Patent Office, the disclosure of which is incorporated herein by reference.

BACKGROUND

The present invention relates to an image forming apparatus including: an image carrier unit integrally having a plurality of image carriers, which respectively carries an image; and a unit containing portion which removably contains the image carrier unit. The present invention also relates to a technique associated with the image forming apparatus.

Conventional laser color printers are generally provided with a plurality of photoreceptor drums for carrying images corresponding to the respective colors in one direction.

In addition, some conventional laser color printers are provided with a plurality of drive motors corresponding to the respective photoreceptor drums rotatably secured to the bodies of the printers, so that the driving force of each drive motor can be individually transmitted to each of the photoreceptor drums, and thus, can drive all of the photoreceptor drums stably with a sufficient driving force.

In such laser color printers, a drum gear for transmitting a driving force to a photoreceptor drum is connected to each of the photoreceptor drums, and a plurality of body gears which receive a driving force from the drive motors are engaged with the respective drum gears.

The drum gears and the body gears are formed in such a manner that the center of each circle works as the center of rotation. However, in a precise sense, the center of rotation slightly deviates from the center of the circles. Therefore, the displacement rate on the outer circumference of the gears at the time of rotation (the displacement amount on the outer circumference per unit time) is not constant.

When images, carried by respective the photoreceptor drums, are sequentially superposed on a sheet of paper conveyed in the above-described laser printer, the respective images are misaligned due to the dislocation of the center of gear rotation. A solution is required so as to inhibit misalignment of images carried by the photoreceptor drums.

For this purpose, in the above-described laser printer, a phase reference point is predetermined for the respective gears based on the dislocation of the rotational center, and the phase differences between the adjacent drum gears and between the adjacent body gears are set so as to be respectively constant.

SUMMARY

In the above-described laser color printers, the photoreceptor drums are secured to the bodies of the laser color printers, and this results in a problem such that in some cases, the maintenance work becomes difficult.

Therefore, a configuration is considered in this laser color printers, wherein a plurality of photoreceptor drums may be integrated as one unit, and configured so as to be removable from the body of the laser color printer, In this case, there is a possibility that the drum gears and the body gears may interfere with each other when the photoreceptor drums are removed or a user accidentally touches a photoreceptor drum, a drum gear or a body gear after the photoreceptor drums are removed, and thus, these gears may rotate, and make the phase differences between the adjacent drum gears or between the adjacent body gears out of predetermined phase differences.

For this reason, in one aspect of the present invention, a technique is preferably provided wherein a plurality of image carriers integrated in a removable manner can be stably driven by a plurality of driving sources, and wherein phase differences between the adjacent gears for driving the image carriers can be inhibited from becoming out of predetermined phase differences.

In one aspect of the present invention, an image forming apparatus includes an image carrier unit, a unit containing portion, driving units, driving sources, and a phase change matching unit. The image carrier unit integrally has image carriers that respectively carry images, and respectively have rotational shafts. The unit containing portion removably contains the image carrier unit. Each of the driving units includes at least one driving gear, and transmits driving force by the driving gear to the rotational shaft of one of the image carriers that corresponds thereto. The driving sources apply the driving force to the driving gears of the driving units. The phase change matching unit matches phase changes in the driving gears of the driving units when no image is formed.

In this image forming apparatus, all the phase changes between the driving gears match, when no image is formed. Therefore, phase differences between the adjacent driving gears may be inhibited from becoming out of predetermined phase differences.

In another aspect of the present invention, an image carrier unit includes image carriers, a housing, gears, and a phase change matching unit. The image carriers respectively carry images, and have rotational shafts. The housing integrally supports the image carriers. The gears are respectively connected to the rotational shafts. The phase change matching unit matches phase changes of the gears in response to a condition in which no image is formed.

In this image carrier unit, all the phase changes between the gears match. Therefore, the phase differences between the adjacent gears may be inhibited from becoming out of the predetermined phase differences.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

First Embodiment

<External Structure of Printer 100 in First Embodiment>

In the following, when the disposition order of a plurality of constituents is indicated, the start point of the order is set in the front side of a printer 100. That is, the constituent disposed in the most front side of the printer 100 is referred to as the first one among the plurality of constituents.

Figure 1:
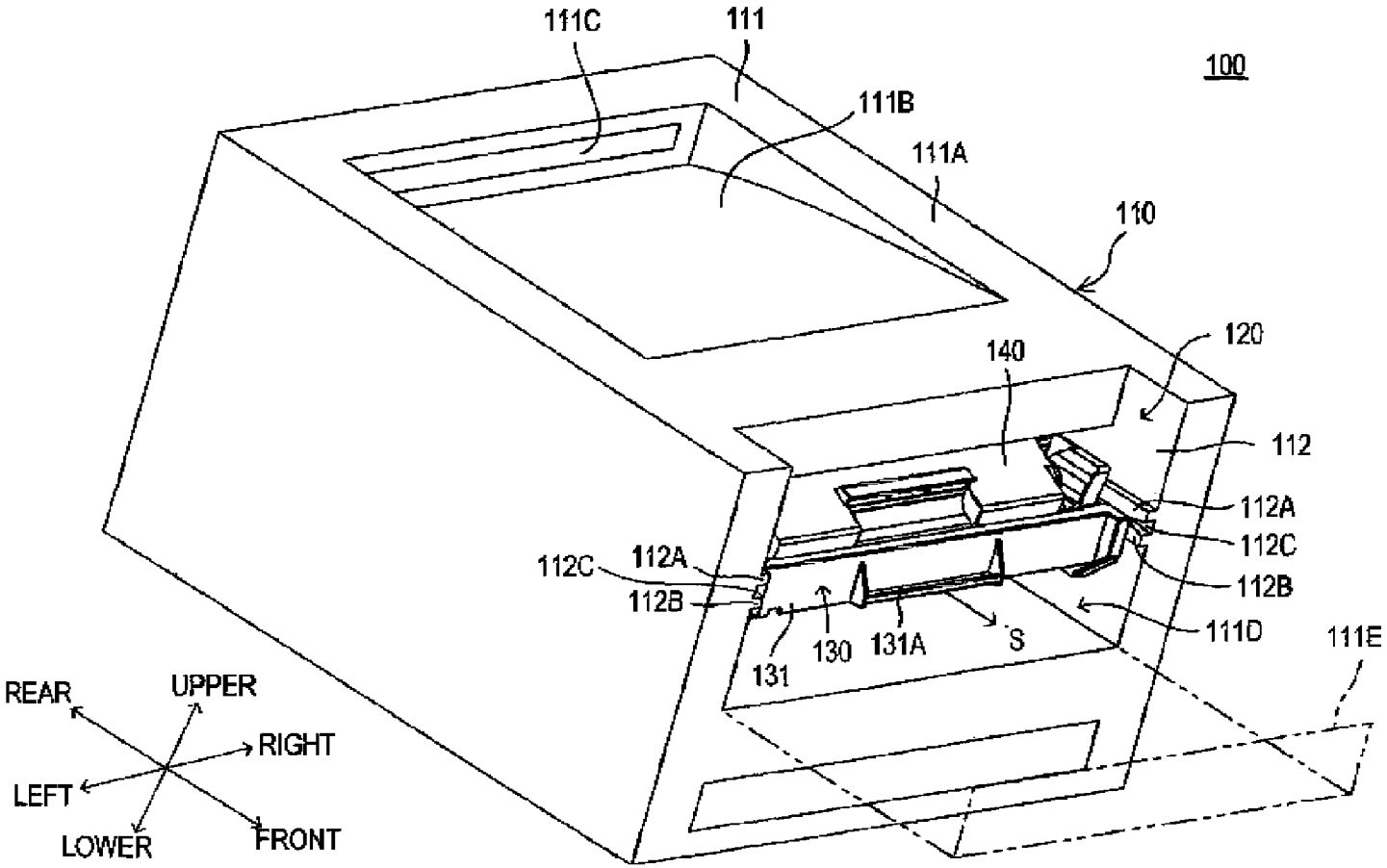
FIG. 1 is a perspective view showing an exterior appearance of a printer according to a first embodiment of the present invention.

As shown in FIG. 1, a body 110 of the printer 100 includes a body casing 111 and a body frame 112 contained inside of the body casing 111.

The body casing 111 is made of synthetic resin, and formed approximately in a rectangular parallelepiped shape. On a top surface 111A of the body casing 111, a paper discharge tray 111B is formed. The paper discharge tray 111B is downwardly inclined from the front side of the body casing 111 toward the rear side thereof. A paper discharge opening 111C is disposed in an upper portion of the body casing 111 above the rear end portion of the paper discharge tray 111B. Paper is discharged through the paper discharge opening 111C on to the paper discharge tray 111B.

In a front side of the body casing 111, a front opening 111D is formed. A front cover 111E is disposed in an openable/closable manner for closing the front opening 111D. The lower end of the front cover 111E is supported by the body casing 111.

The body frame 112 is configured so as to support various members provided for an image forming operation inside of the body 110. Driving sources and driving force transmission mechanisms are disposed inside of the body frame 112 for rotating and driving the various members.

The left inner wall and the right inner wall of the body frame 112 are respectively provided with upper side guide rails 112A and lower side guide rails 112B. More specifically, the respective upper side guide rails 112A are disposed approximately horizontally from the front side of the printer 100 toward the rear side thereof, while the respective lower side guide rails 112B are disposed approximately parallel to the upper side guide rails 112A. Guide grooves 112C are formed approximately horizontally between the upper side guide rails 112A and the lower side guide rails 112B.

In the body frame 112, an image forming unit 120 is installed such that the image forming unit 120 can be removed in a direction (shown with Arrow S in the figure) from the rear side of the printer 100 toward the front side thereof. In other words, the rear side of the printer 100 corresponds to the upstream side of the removal direction of the image forming unit 120, and the front side of the printer 100 corresponds to the downstream side of the removal direction.

<External Structure of Image Forming Unit 120>

Figure 2:
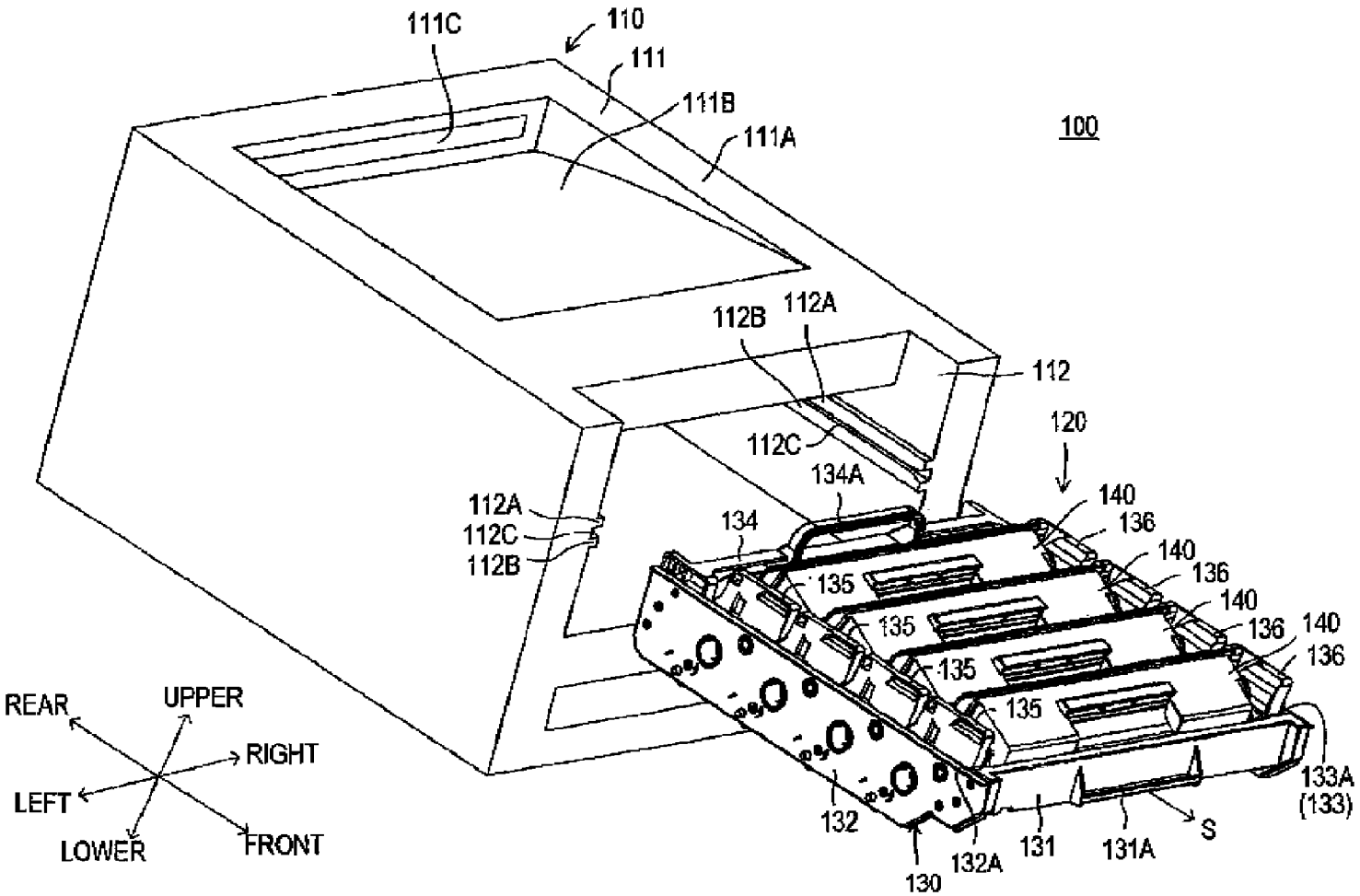
FIG. 2 is a perspective view showing the exterior appearance of the printer and an image forming unit in which the image forming unit is removed outside of the printer.

As shown in FIG. 2, the image forming unit 120 includes a drum unit 130, and four development cartridges 140.

The drum unit 130 includes a frame forming approximately a quadrangular plane with a front beam 131, a left supporting plate 132, a right supporting plate 133, and a rear beam 134.

More specifically, the front beam 131 and the rear beam 134, respectively provided in the front end side and in the rear end side of the drum unit 130, are disposed in parallel to each other. To the left and right ends of the respective front beam 131 and the rear beam 134, the left supporting plate 132 and the right supporting plate 133 are connected. In the inner side of the left supporting plate 132, four left plates 135 are aligned along the left supporting plate 132. In the inner side of the right supporting plate 133, four right plates 136 are aligned along the right supporting plates 133.

Between the left plates 135 and the right plates 136, the above-described development cartridges 140 are aligned from the front side of the drum unit 130 toward the rear side thereof. The development cartridges 140 are respectively supported by the left plates 135 and the right plates 136 in an attachable/detachable manner.

In the drum unit 130, flange portions 132A and 133A which are engaged with the above-described guide grooves 112C are formed on the upper end portions of the left side supporting plate 132 and the right side supporting plate 133, respectively. That is, the drum unit 130 is guided along the guide grooves 112C in the forward and backward directions of the body frame 112 by engagement of these flange portions 132A and 133A with the guide grooves 112C.

The drum unit 130 is provided with a front handle 131A in the front surface of the front beam 131. The drum unit 130 can be easily removed from the body frame 112 by a user pulling the front handle 131A toward the front side of the body frame 112.

The drum unit 130 is also provided with a rear handle 134A in the upper end portion of the rear beam 134. The drum unit 130 can be easily carried by a user holding the front handle 131A and the rear handle 134A.

Figure 3:
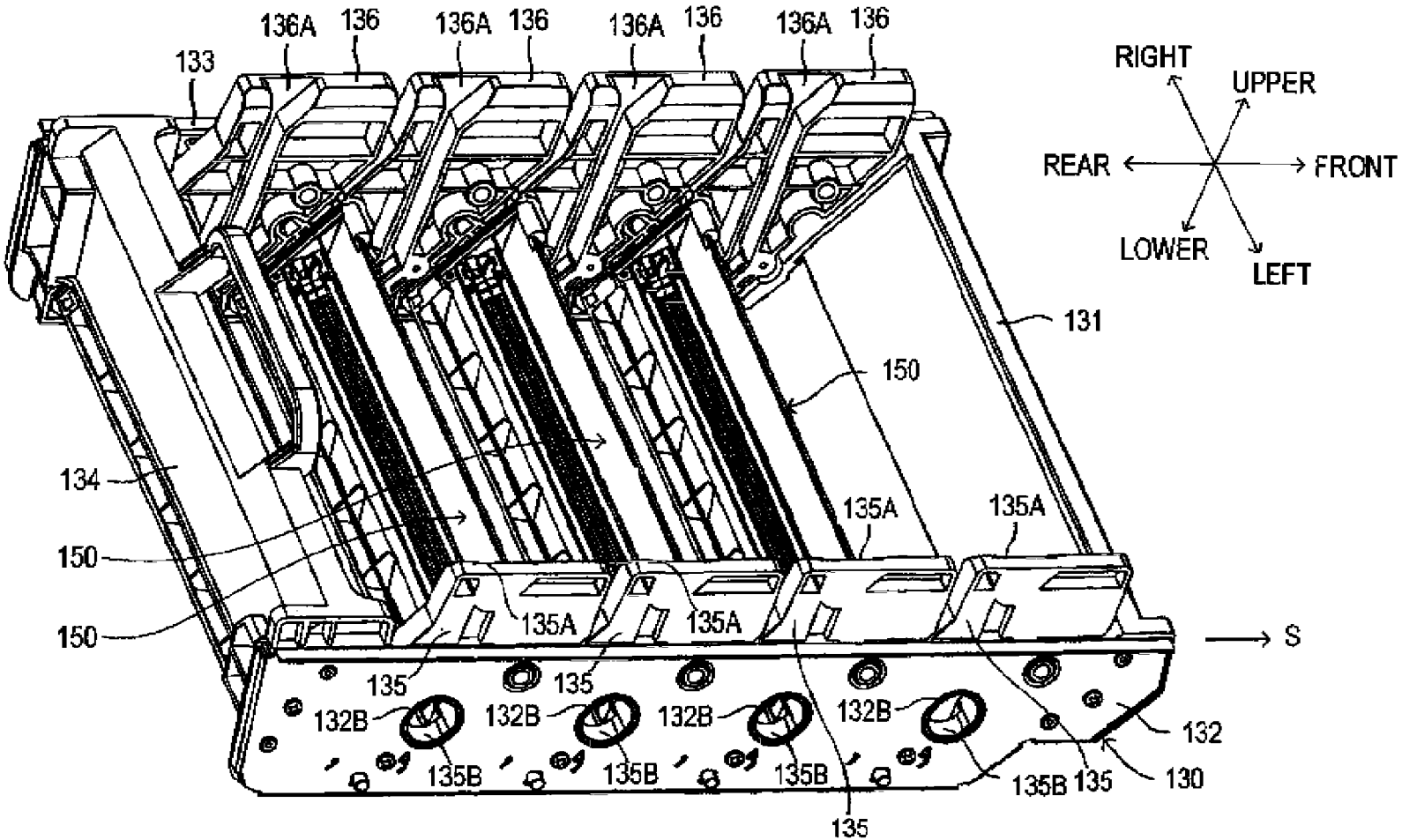
FIG. 3 is a perspective view showing an exterior appearance of a drum unit from which all development cartridges are removed.

As shown in FIG. 3, the left supporting plate 132 of the drum unit 130 is provided with four coupling insertion holes 132B along the disposition direction of the development cartridges 140 such that the respective coupling insertion holes 132B face the respective development cartridges 140. Each of the left plates 135 is provided with a coupling exposure hole 135B in a position so that the coupling exposure hole 135B faces the coupling insertion hole 132B.

The coupling insertions holes 132B and the coupling exposure holes 135B are provided for inserting driving shafts (not shown) disposed within the body frame 112 so as to apply driving force to coupling receiving gears (not shown) disposed in the development cartridges 140.

On the respective inner walls of the left plates 135 and the right plates 136, guide grooves 135A, 136A are formed for guiding the development cartridges 140 in the up-and-down direction.

In the bottom portion of the drum unit 130, four drum portions 150 are disposed along the disposition direction of the development cartridges 140 (only first three drum portions 150 from the front side are shown in FIG. 3).

<Internal Structure of Printer 100>

Figure 4:
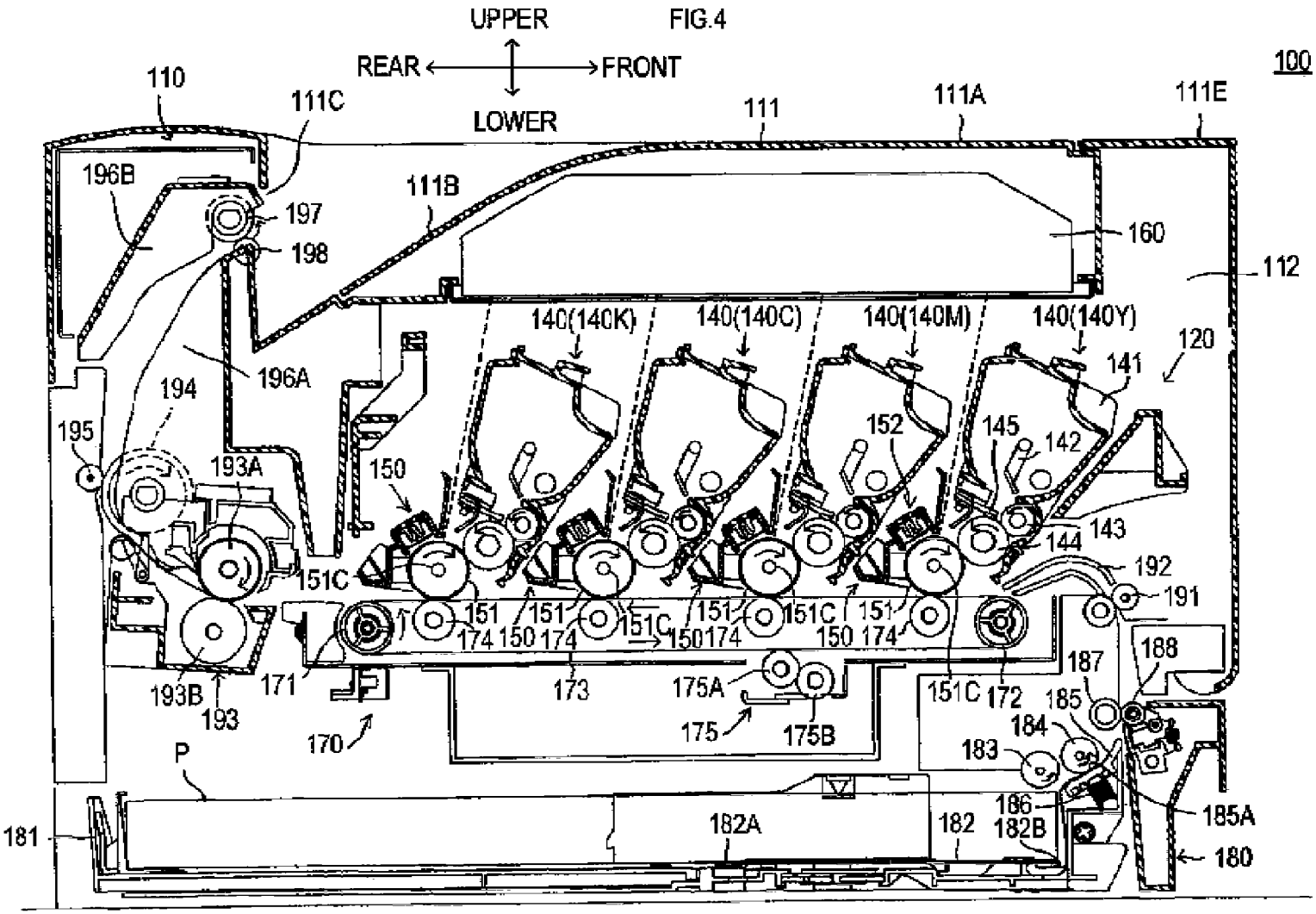
FIG. 4 is a cross sectional view showing an internal structure of the printer in which the image forming unit is installed.

As shown in FIG. 4, in the body 110 of the printer 100, the image forming unit 120 is disposed in the center portion thereof, and the paper discharge unit 193 is disposed behind the image forming unit 120.

The body 110 further includes a scanner unit 160, a transfer unit 170, and a feeder unit 180. The scanner unit 160 is disposed above the image forming unit 120. The transfer unit 170 is disposed below the image forming unit 120. The feeder unit 180 is disposed below the transfer unit 170.

<<Structure of Feeder Unit 180>>

The feeder unit 180 includes a feeder case 181, a feed roller 183, a separation roller 184, a separation pad 185, and a paper dust removal roller 187.

The feeder case 181 is formed in such a manner that sheets of paper P can be stacked inside thereof. In the feeder case 181, a paper pressing plate 182 is disposed. A rear end portion 182A of the paper pressing plate 182 is rotatably supported inside of the feeder case 181. That is, in the feeder case 181, a front end portion 182B of the paper pressing plate 182 is swayed approximately in the up-and-down direction in the figure.

The feed roller 183 is made of synthetic rubber. The feed roller 183 is rotatably supported above the front end portion 182B of the paper pressing plate 182 by the body frame 112. The feed roller 183 is driven so as to rotate in the counterclockwise direction in the figure, and conveys a sheet of paper P, stacked on the top inside of the feeder case 181, toward the front side of the feed roller 183.

The separation roller 184 is made of synthetic rubber in the same manner as the feed roller 183. The separation roller 184 is rotatably supported by the body frame 112 in the front side of the feed roller 183. The separation roller 184 is driven so as to rotate in the same direction as the feed roller 183, and conveys the sheet of paper P toward the front side thereof.

The separation pad 185 is disposed so as to face the separation roller 184. A separation surface 185A of the separation pad 185 facing the separation roller 184 is made of a material having a high friction coefficient, such as synthetic rubber, felt, and so on. Below the separation pad 185, a separation pad biasing spring 186 is disposed. By the separation pad biasing spring 186 biasing the separation pad 185 toward the separation roller 184, the separation roller 184 and the separation pad 185 are pressed against each other.

The paper dust removal roller 187 removes paper dust adhered to the sheet of paper P. The paper dust removal roller 187 is disposed above and in the front side of the separation roller 184 so as to face a pinch roller 188, and rotatably supported by the body frame 112.

<<Structure of Image Forming Unit 120>>

In the image forming unit 120, the four development cartridges 140 (140Y, 140M, 140C, and 140K) are aligned from the front side of the printer 100 toward the rear side thereof. Beneath the development cartridges 140, the four drum portions 150 are aligned from the front side of the printer 100 toward the rear side thereof, so as to face the development cartridges 140.

The four development cartridges 140Y, 140M, 140C, and 140K respectively contain a toner (a developer) in a color different from one another, such as yellow, magenta, cyan, and black. Although the development cartridges 140Y, 140M, 140C, and 140K contain toners of different colors, the structures thereof are exactly the same.

More specifically, the development cartridges 140 respectively contain a toner, which is a developer for developing an electrostatic latent image, in a cartridge case 141. The development cartridges 140 respectively include an agitator 142, a supply roller 143, a development roller 144, and a blade 145.

The agitator 142 stirs a toner contained in the cartridge case 141, and is rotatably supported by the cartridge case 141.

The supply roller 143 is made of a sponge roller, and rotatably supported by the cartridge case 141.

The development roller 144 is made of a rubber roller, and rotatably supported by the cartridge case 141.

The supply roller 143 and the development roller 144 are disposed such that the supply roller 143 and the development roller 144 face each other and the periphery surfaces thereof contact with each other. The supply roller 143 is driven so as to rotate in the counterclockwise direction in the figure, and supplies an electrically-charged toner to the periphery surface of the development roller 144.

The blade 145 is disposed so as to abut on the periphery surface of the development roller 144. The blade 145 adjusts the amount of the toner supplied on to the periphery surface of the development roller 144, which is driven so as to rotate in the counterclockwise direction in the figure.

The four drum portions 150 are configured exactly in the same manner. The drum portions 150 respectively include a photoreceptor drum 151 and a scorotron charger 152.

The photoreceptor drum 151 has a photoreceptive layer, made of a photoconductor, on the periphery surface thereof. The photoreceptor drum 151 is disposed such that the periphery surface thereof faces the periphery surface of the development roller 144 in the development cartridge 140.

The photoreceptor drum 151 is rotatable supported by the drum unit 130, and driven so as to rotate in the clockwise direction in the figure by a drive mechanism to be described later. However, the direction of all the rotational shafts 151C of the photoreceptor drums 151 is set to be perpendicular to the installation direction of the drum unit 130 in a horizontal plane (a direction perpendicular to the surface of the drawing). That is, all the rotational shafts 151C are disposed in parallel to one another.

The scorotron charger 152 is constituted so as to uniformly charge the periphery surface of the photoreceptor drum 151. The scorotron charger 152 is disposed above the photoreceptor drum 151 so as to face the periphery surface of the photoreceptor drum 151.

<<Structure of Scanner Unit 160>>

The scanner unit 160 is constituted so as to emit laser beam, generated based on image data, from a laser emission portion (not shown) on to the periphery surfaces of the photoreceptor drums 151. Also the scanner unit 160 is constituted so as to scan laser beam emitted therefrom in the width direction of the printer 100 (the direction perpendicular to the surface of FIG. 4).

<<Structure of Transfer Unit 170>>

The transfer unit 170 includes a belt driving roller 171, a driven roller 172, a conveyance belt 173, four transfer rollers 174, and a belt cleaner 175.

The belt driving roller 171 is disposed below and behind the drum portion 150 facing the development cartridge 140K disposed in the most rear side among the four development cartridges 140. The belt driving roller 171 is rotatably supported by the body frame 112.

The driven roller 172 is disposed below and in the front side of the drum portion 150 facing the development cartridge 140Y disposed in the most front side among the four development cartridges 140. The driven roller 172 is rotatably supported by the body frame 112.

The conveyance belt 173 is an endless belt made of a resin film, such as conductive polycarbonate or polyimide, wherein conductive particles, such as carbon, are dispersed. The conveyance belt 173 runs between the belt driving roller 171 and the driven roller 172.

The conveyance belt 173 is moved in the counterclockwise direction in the figure by the belt driving roller 171 being driven so as to rotate in the counterclockwise direction. The conveyance belt 173 conveys the sheet of paper P placed thereon along the disposition direction of the development cartridges 140.

The transfer rollers 174 are respectively disposed beneath the respective photoreceptor drums 151 so as to face the photoreceptive drums 151 of the drum portions 150 with the conveyance belt 173 in between. The transfer rollers 174 are rotatably supported by the body frame 112, and rotated corresponding to the conveyance belt 173 moving counterclockwise.

The belt cleaner 175 is disposed beneath the second transfer roller 174 among the four transfer rollers 174.

The belt cleaner 175 removes toner and paper dust adhered to the surface of the conveyance belt 173 by a pair of cleaning rollers 175A, 175B.

<<Structure of Paper Discharge Unit 193>>

The paper discharge unit 193 includes a heat roller 193A and a pressure roller 193B.

The heat roller 193A is constituted with a metal cylinder, having a surface treated with a mold release process, and a halogen lamp contained in the cylinder. The heat roller 193A is rotatably supported by the body frame 112.

The pressure roller 193B is made of silicone rubber, and disposed so as to be pressed against the heat roller 193A at predetermined pressure. The pressure roller 193B is rotatably supported by the body frame 112.

In the paper discharge unit 193, when the heat roller 193A is driven so as to rotate in the clockwise direction in the figure, the pressure roller 193B is correspondingly rotated in the counterclockwise direction. The sheet of paper P, conveyed from the transfer unit 170, is fed between the heat roller 193A and the pressure roller 193B, and conveyed behind the rollers 193A and 193B. As a result, a toner on the sheet of paper P melts and adheres (is fixed) to the sheet of paper P. Then, the sheet of paper P is conveyed toward the paper discharge opening 111C.

The paper discharge unit 193 furthermore includes a conveyance roller 194 for conveying the sheet of paper P on which toner is adhered, and a pinch roller 195. The conveyance roller 194 and the pinch roller 195 are disposed behind the heat roller 193A and the pressure roller 193B.

The conveyance roller 194 is rotatably supported by the body frame 112.

The pinch roller 195 is disposed so as to face the conveyance roller 194, and rotatably supported by the body frame 112.

By the conveyance roller 194 being driven so as to rotate in the clockwise direction in the figure, the pinch roller 195 is correspondingly rotated in the counterclockwise direction in the figure. As a result, the sheet of paper P is conveyed toward the paper discharge opening 111C.

The paper discharge unit 193 still further includes paper guides 196A, 196B disposed above the conveyance roller 194 and the pinch roller 195, for guiding the sheet of paper P with a toner adhered thereon.

The paper guides 196A and 196B guide the sheet of paper P, conveyed by the conveyance roller 194 and the pinch roller 195, toward the paper discharge opening 111C.

The paper discharge unit 193 further includes a paper discharge roller 197 and a paper discharge driven roller 198 both disposed in the vicinity of the paper discharge opening 111C.

The paper discharge roller 197 and the paper discharge driven roller 198 are disposed so as to face each other in the up-and-down direction in the figure and respectively supported by the body frame 112 in a rotatable manner.

By the paper discharge roller 197 being driven so as to rotate in the counterclockwise direction in the figure, the paper discharge driven roller 198 is correspondingly rotated in the clockwise direction. As a results the sheet of paper P is discharged outside of the body 110 from the paper discharge opening 111C.

<<Structure of Drive Mechanism>>

Figure 5:
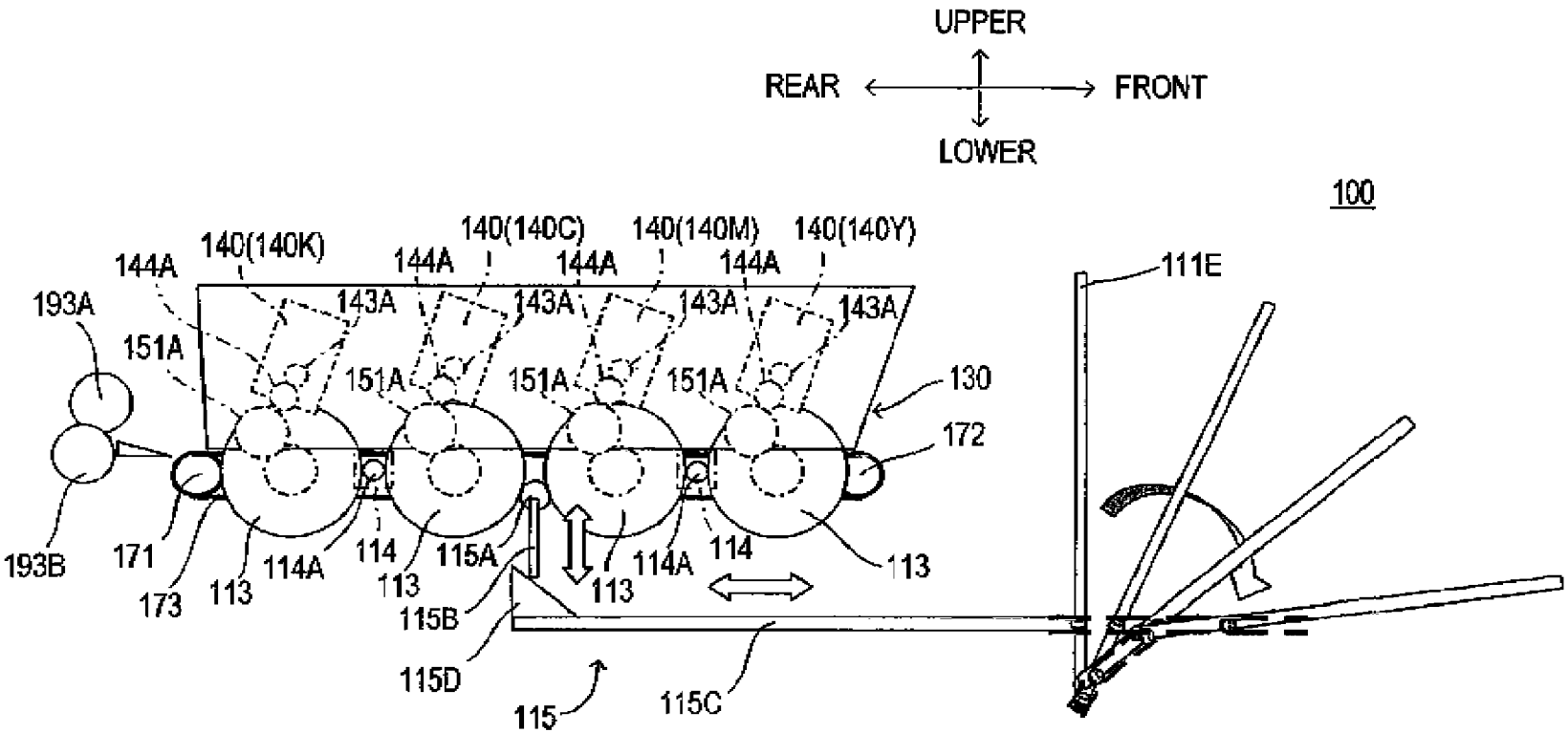
FIG. 5 is a schematic view showing a structure of a drive mechanism for driving various parts of the image forming unit as installed in a body frame of the printer.

As shown in FIG. 5, the left outer walls of respective development cartridges 140 are provided with a supply roller driving gear 143A and a development roller driving gear 144A. The supply roller driving gear 143A is connected to the rotational shaft of the supply roller 143. The development roller driving gear 144A is connected to the rotational shaft of the development roller 144. The respective teeth of the supply roller driving gear 143A and the development roller driving gear 144A are engaged with the teeth of the above-described coupling receiving gear. When driving force is applied from the above-described driving shaft to the coupling receiving gear, the supply roller driving gear 143A and the development roller driving gear 144A are correspondingly rotated.

Inside of the drum unit 130, four drum gears 151A are disposed so as to be respectively connected to the rotational shafts 151C of the photoreceptor drums 151. Phases of the respective drum gears 151A, which indicate rotational angles thereof, are determined with respect to reference rotational positions thereof. The reference rotational positions are set based on the locations of the rotational centers of the respective drum gears 151A. The rotational orientations of the respective drum gears 151A are set such that phase differences between the first and second drum gears 151A, between the second and third drum gears 151A, and between the third and fourth drum gears 151A are predetermined phase differences. The predetermined phase differences may be all the same, or be partly the same, or be different from each other.

The body frame 112 (not shown in FIG. 5) is provided with four body gears 113 constituted with two-stage gears. The body gears 113 are disposed beneath the drum unit 130, and rotatably supported by the body frame 112. More specifically, the body gears 113 are disposed along the disposition direction of the drum gears 151A. The teeth on the inner side of the body gears 113 are engaged with the teeth of the drum gears 151A. Phases of the respective body gears 113, which indicate rotational angles thereof are determined with respect to reference rotational positions thereof. The reference rotational positions are set based on the locations of the rotational centers of the respective body gears 113. The rotational orientations of the respective body gears 113 are set such that phase differences between the first and second body gears 113, between the second and third body gears 113, and between the third and fourth body gears 113 are predetermined phase differences. The predetermined phase differences may be all the same, or be partly the same, or be different from each other.

The body frame 112 is further provided with two drive motors 114. More specifically, the drive motors 114 are respectively disposed between the first and second body gears 113, as well as between the third and fourth body gears 113.

The teeth of a motor gear 114A which is connected to the rotational shaft of the drive motor 114 disposed between the first and second body gears 113 are engaged with the outside teeth of these two body gears 113. On the other hand, the teeth of a motor gear 114A which is connected to the rotational shaft of the drive motor 114 disposed between the third and fourth body gears 113 are engaged with the outside teeth of these two body gears 113.

Below these body gears 113, a body gear interlocking mechanism 115 is provided. The body gear interlocking mechanism 115 interlocks the second and third body gears 113.

More specifically, the body gear interlocking mechanism 115 includes an interlocking gear 115A, a gear supporting member 115B, and a link 115C.

The interlocking gear 115A is provided below the portion between the second and third body gears 113 in a moveable manner in the up-and-down direction in the figure.

The gear supporting member 115B is a member in a rod form directed in the vertical direction. The upper end portion of the gear supporting member 115B rotatably supports the interlocking gear 115A.

The link 115C is a member in a plate form directed in the horizontal direction. The front end portion of the link 115C is connected in the vicinity of the lower end portion of the above-described front cover 111E. As a result, together with the operation of the front opening 111D being opened, the link 115C moves to the front side, and together with the operation of the front opening 111D being closed, the link 115C moves to the rear side.

On the upper surface of the rear end portion of the link 115C an inclined member 115D is provided. The inclined member 115D has a slanted surface which is upwardly inclined from the front side of the inclined member 115D.

The inclined member 115D pushes up the connecting gear 115A with the slanted surface making contact with the lower end portion of the gear supporting member 115B when the link 115C moves to the front side. As a result, the interlocking gear 115A is pressed up to the portion between the second and third body gears 113, and thus, the teeth of the interlocking gear 115A are engaged with the outside teeth of these two body gears 113 (that is, these two body gears 113 are interlocked therebetween).

The slanted surface of the inclined member 115D moves away from the lower end portion of the gear supporting member 115B when the link 115C moves to the rear side. As a result, the interlocking gear 115A moves down due to its own weight and away from the portion between the two body gears 113.

<Effects of Printer 100>

In the printer 100 according to the first embodiment, the second and third body gears 113 are interlocked therebetween by the body gear interlocking mechanism 115 when the front opening 111D is opened and no image is formed. Thereby, all of the body gears 113 rotate in sync, when the body gears 113 rotate at the time of removal of the image forming unit 120. That is, the phase changes of the respective body gears 113 are consistent therebetween. Accordingly, the phase differences between the adjacent body gears 113 can be inhibited from becoming out of the predetermined phase differences.

On the other hand, when the front opening 111D is closed and an image is formed, the interlock between the second and third body gears 113 is disengaged by the body gear interlocking mechanism 115. As a result, the four photoreceptor drums 151 can be stably driven by the two drive motors 114 without the driving forces from the two drive motors 114 interfering between the respective body gears 113.

That is, in the printer 100 according to the first embodiment, the plurality of photoreceptor drums 151 removably integrated can be stably driven by the plurality of drive motors 114, and the phase differences between the adjacent body gears 113 can be inhibited from becoming out of the predetermined phase differences when the image forming unit 120 is removed.

Moreover, in the printer 100 according to the first embodiment, all of the body gears 113 can be interlocked the between in a simple structure where the interlocking gear 115A is disposed between the second and third body gears 113. On the other hand, the interlock between these two body gears 113 can be disengaged in a simple structure where the interlocking gear 115A is disengaged from the portion between the second and third body gears 113.

In the printer 100 according to the first embodiment, the body gears 113 are interlocked therebetween as a user opens the front opening 111D in order to remove the image forming unit 120 from the inside of the body frame 112. As a result, the user can remove the image forming unit 120 immediately after opening the front opening 111D.

In the printer 100 according to the first embodiment, the interlock between the second and third body gears 113 is disengaged as a user installs the image forming unit 120 inside the body frame 112 and closes the front opening 111D in order to form an image. As a result, the photoreceptor drums 151 can be stably driven in the printer 100 immediately after the front opening 111D is closed.

In the printer 100 according to the first embodiment, the first and second body gears 113, which are adjacent to each other, and the third and fourth body gears 113, which are adjacent to each other, are interlocked therebetween via the motor gears 114A. Therefore, in the printer 100, four photoreceptor drums 151 can be stably driven with two drive motors 114 instead of four drive motors 114, which is the same number as that for photoreceptor drums 151. Moreover, all of the body gears 113 can be simply interlocked by disposing an interlocking gear 115A in the portion between the second and third body gears 113, where the second and third body gears 113 are not engaged with the motor gear 114A.

Second Embodiment

A printer according to the second embodiment can be simply obtained by partially modifying the structure of the above-described printer 100 according to the first embodiment. Accordingly, the same reference numbers are used for components that are the same as in the printer 100 according to the first embodiment, and the descriptions thereof are not repeated here. The following describes only the distinctive structure.

<Structure of Drive Mechanism>

Figure 6:
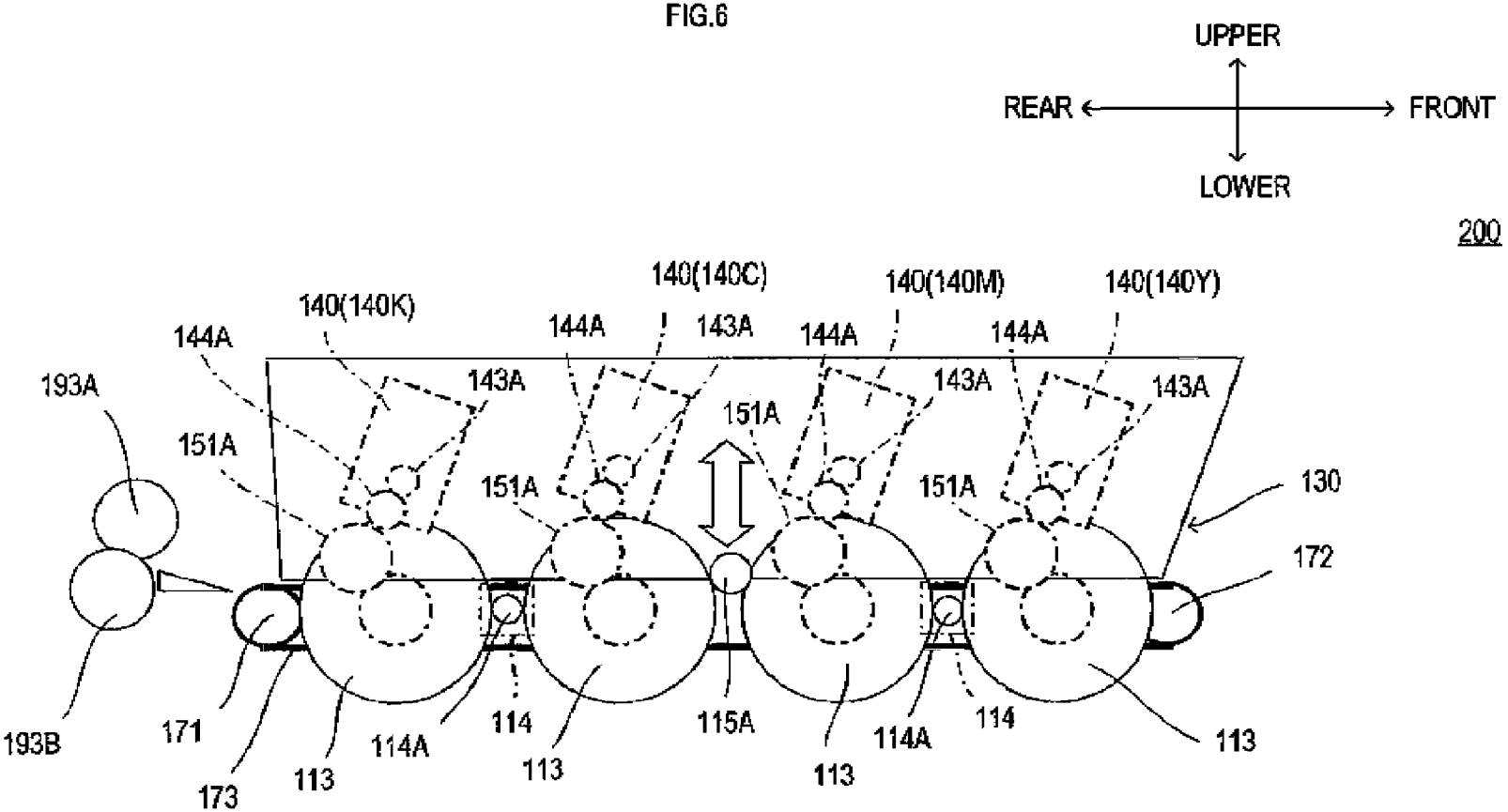
FIG. 6 is a schematic view showing a structure of a drive mechanism in a printer according to a second embodiment of the present invention.
Figure 7:
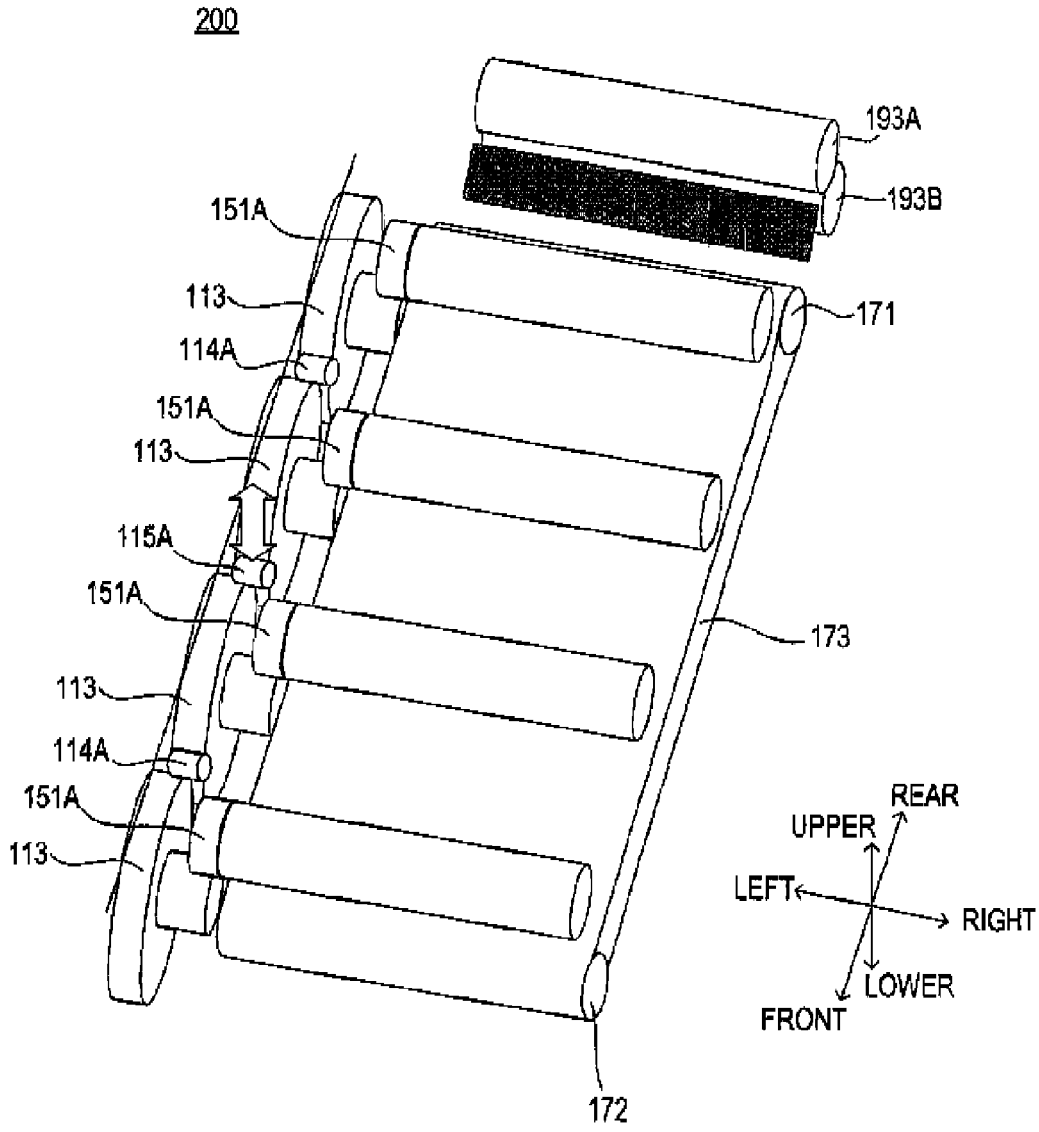
FIG. 7 is a perspective view showing the drive mechanism according to the second embodiment.

As shown in FIGS. 6 and 7, in the printer 200, the above-described interlocking gear 115A is provided above the portion between the second and third body gears 113 in a moveable manner in the up-and-down direction.

In the printer 200, the interlocking gear 115A moves downward and interlocks between the second and third body gears 113 when the front opening 111D is opened. On the other hand, the interlocking gear 115A moves upward and disengages from these body gears 113 when the front opening 111D is closed.

<Effects of Printer 200>

In the printer 200 according to the second embodiment, the second and third body gears 113 are interlocked when the front opening 111D is opened, and the interlock between these body gears 113 is disengaged when the front opening 111D is closed. Therefore, the same effects as in the above-described printer 100 according to the first embodiment can be obtained.

Third Embodiment

A printer 300 according to the third embodiment can be simply obtained by partially modifying the structure of the above-described printer 100 according to the first embodiment. Accordingly, the same reference numbers are used for components that are the same as in the printer 100 according to the above-described first embodiment, and the descriptions thereof are not repeated here. The following describes only the distinctive structure.

<Structure of Drive Mechanism>

Figure 8:
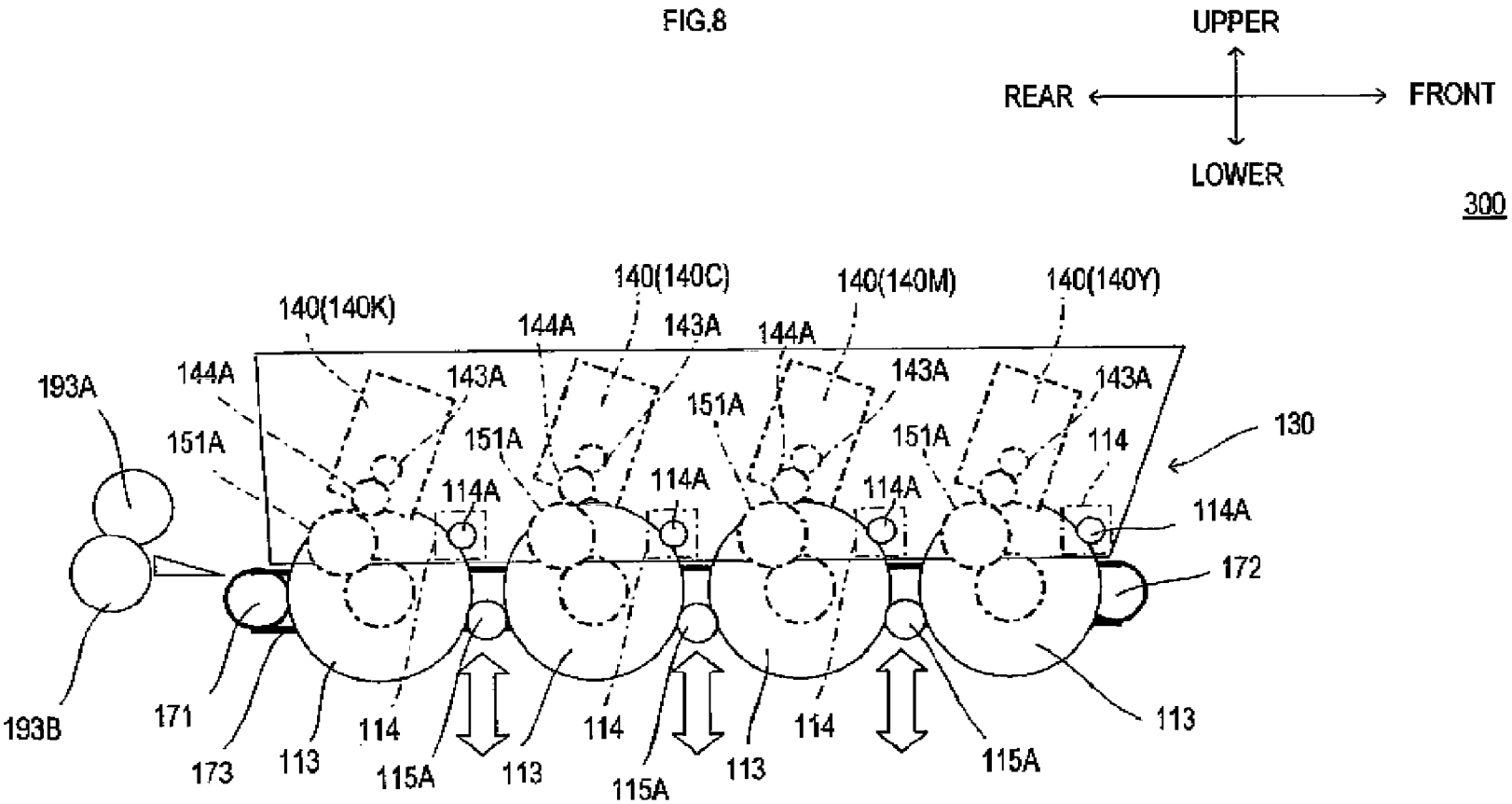
FIG. 8 is a schematic view showing a structure of a drive mechanism in a printer according to a third embodiment of the present invention.

As shown in FIG. 8, in the printer 300, the above-described drive motor 114 are provided so as to correspond to the respective body gears 113 (that is, four drive motors 114 are provided). In addition, the teeth of each motor gear 114A are engaged with the outside teeth of the corresponding body gear 113.

In addition, the above-described interlocking gears 115A are respectively provided below the portions between the first and second body gears 113 and between the second and third body gears 113, as well as between the third and fourth body gears 113, in a moveable manner in the up-and-down direction (that is, three interlocking gears 115A are provided).

In the printer 300, three interlocking gears 115A move upward and interlock adjacent body gears 113 when the front opening 111D is opened. On the other hand, these interlocking gears 115A move downward and disengage from these body gears 113 when the front opening 111D is closed.

<Effects of Printer 300>

In the printer 300 according to the third embodiment, adjacent body gears 113 are interlocked when the front opening 111D is opened, and the interlock of these body gears 113 is disengaged when the front opening 111D is closed. Therefore, the same effects as in the above-described printer 100 according to the first embodiment can be obtained.

Furthermore, in the printer 300 according to the third embodiment, the respective photoreceptor drums 151 are individually driven by the respective drive motors 114, and therefore, the driving forces of the respective drive motors 114 does not interfere with each other. Accordingly, all of the photoreceptor drums 151 can be reliably and stably driven.

Fourth Embodiment

A printer 400 according to the fourth embodiment can be simply obtained by partially modifying the structure of the printer 100 according to the first embodiment. Accordingly, the same reference numbers are used for components that are the same as in the printer 100 according to the above-described first embodiment, and the descriptions thereof are not repeated here. The following describes only the distinctive structure.

<Structure of Drive Mechanism>

Figure 9:
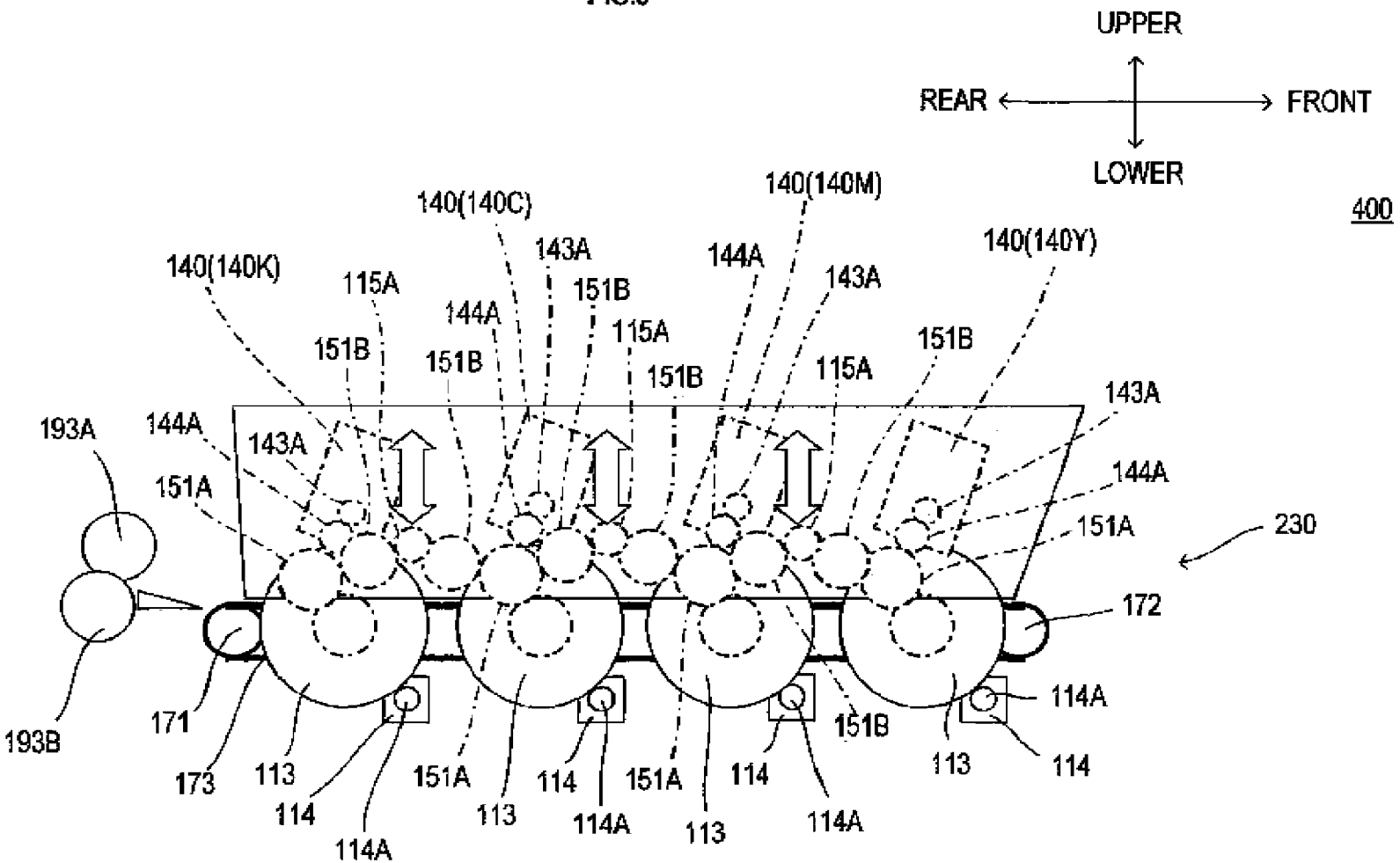
FIG. 9 is a schematic view showing a structure of a drive mechanism in a printer according to a fourth embodiment of the present invention.

As shown in FIG. 9, the printer 400 includes a drum unit 230 instead of the above-described drum unit 130.

The drum unit 230 is formed by adding idle gears 151B and the above-described interlocking gears 115A to the drum unit 130.

More specifically, in the drum unit 230, idle gears 151B are respectively supported in a rotatable manner above the first drum gear 151A on the rear side thereof, above the second drum gear 151A on the front and rear sides thereof, above the third drum gear 151A on the front and rear sides thereof, and above the fourth drum gear 151A on the front side thereof (that is, six idle gears 151B are provided). The teeth of these drum gears 151A and the teeth of these idle gears 151B are engaged.

In the drum unit 230, interlocking gears 115A are provided above the respective portions between adjacent idle gears 151B in a movable manner in the up-and-down direction (that is, three interlocking gears 115A are provided).

In the printer 400, the interlocking gear 115A, which is provided below the portion between the second and third body gears 113 in the above-described printer 100 according to the first embodiment, is omitted.

In the printer 400, the above-described drive motors 114 are provided so as to correspond to the respective body gears 113 (that is, four drive motors 114 are provided). The teeth of each motor gear 114A are engaged with the outside teeth of the corresponding body gear 113.

In the printer 400, the three interlocking gears 115A move downward and interlock the adjacent idle gears 151B when the front opening 111D is opened. On the other hand, these interlocking gears 115A move upward and disengage from these idle gears 151B when the front opening 111D is closed.

<Effects of Printer 400>

In the printer 400 according to the fourth embodiment, adjacent idle gears 151B are interlocked to each other when the front opening 111D is opened, and as a result, all of the drum gears 151A are interlocked. Thereby, all of the drum gears 151A rotate in sync, when the drum gears 151A rotate at the time of removal of the drum unit 230. That is, the phase changes of the respective drum gears 151A are consistent therebetween. Accordingly, the phase differences between the adjacent drum gears 151A can be inhibited from becoming out of the predetermined phase differences.

In addition, the interlock between the idle gears 151B is disengaged when the front opening 111D is closed, and as a result, the interlock between all of the drum gears 151A is disengaged. Thereby, the driving forces of the respective drive motors 114 does not interfere with each other, and all of the photoreceptor drums 151 can be reliably and stably driven.

Fifth Embodiment

A printer 500 according to the fifth embodiment can be simply obtained by partially modifying the structure of the printer 100 according to the first embodiment. Accordingly the same reference numbers are used for components that are the same as in the printer 100 according to the first embodiment, and the descriptions thereof are not repeated here. The following describes only distinctive structure.

<Structure of Drive Mechanism>

Figure 10:
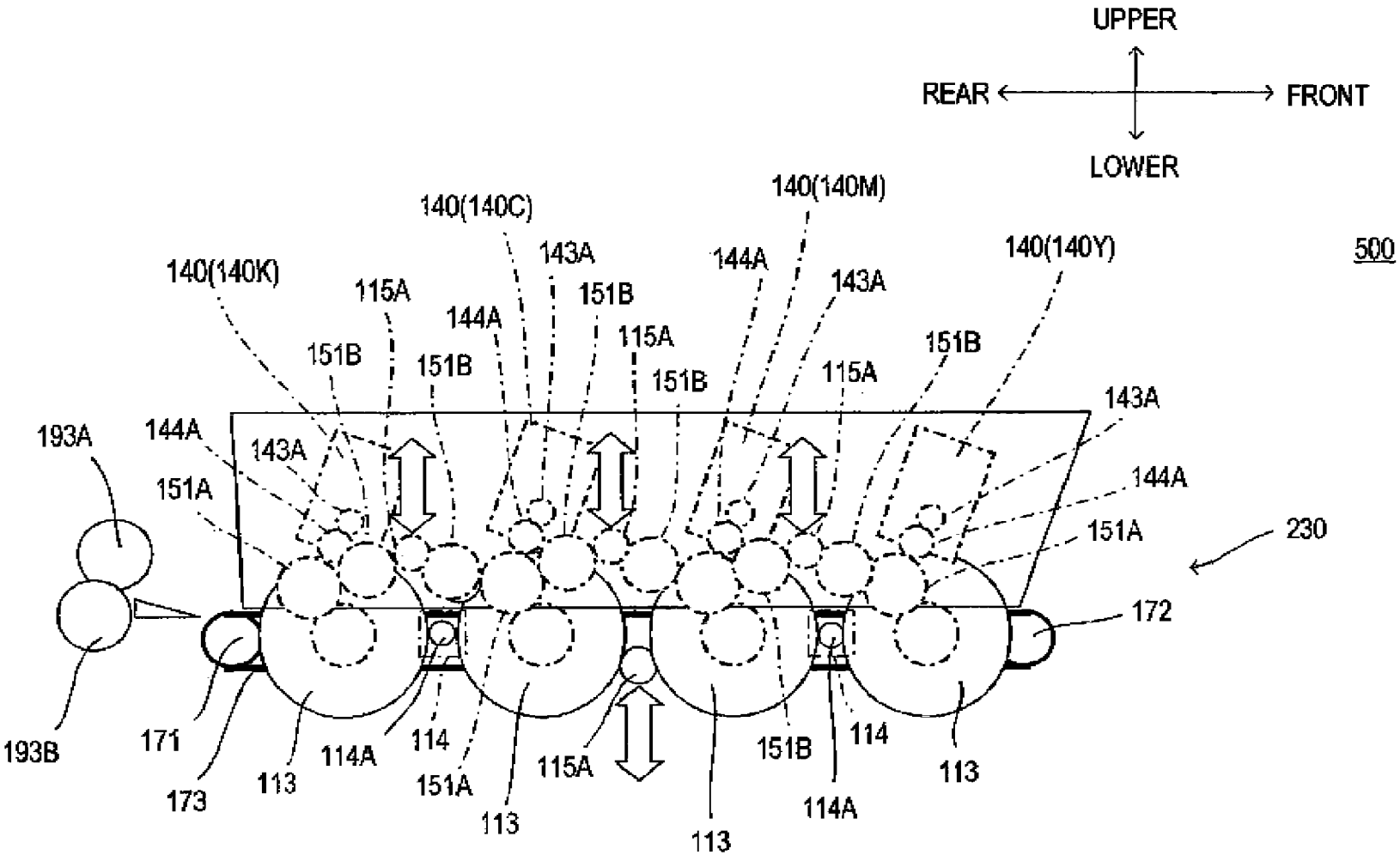
FIG. 10 is a schematic view showing a structure of a drive mechanism in a printer according to a fifth embodiment of the present invention.

As shown in FIG. 10, the printer 500 is different from the printer 100 only in that the above-described drum unit 230 is provided instead of the above-described drum unit 130.

In the printer 500, three interlocking gears 115A provided in the drum unit 230 move downward and interlock the adjacent idle gears 151B, when the front opening 111D is opened. In addition, simultaneously with this, the interlocking gear 115A provided between the second and third body gears 113 moves upward and interlocks these body gears 113.

On the other hand, the three interlocking gears 115A provided in the drum unit 230 move upward and disengage from the adjacent idle gears 151B when the front opening 111D is closed. In addition, simultaneously with this, the interlocking gear 115A provided between the second and third body gears 113 moves downward and disengages from these body gears 113.

<Effects of Printer 500>

In the printer 500 according to the fifth embodiment, the adjacent idle gears 151B are interlocked when the front opening 111D is opened, and as a result, all of the drum gears 151A are interlocked, and all of the body gears 113 are also interlocked.

Therefore, all of the drum gears 151A rotate in sync when the drum gears 151A rotate at the time of removal of the drum unit 230, and all of the body gears 113 rotate in sync when the body gears 113 rotate at the time of removal of the drum unit 230.

As a result, the phase difference between the adjacent drum gears 151A and the phase difference between the adjacent body gears 113 can be inhibited from becoming out of the predetermined phase differences.

In addition, the interlock between all of the drum gears 151A is disengaged and the interlock between the second and third body gears 113 is also disengaged, when the front opening 111D is closed. Therefore, the four photoreceptor drums 151 can be stably driven by the two drive motors 114.

[Variation]

Although specific embodiments have been illustrated and described herein, it is to be understood that the above description is intended to be illustrative, and not restrictive. Combinations of the above embodiments and other embodiments will be apparent to those of skill in the art upon reviewing the above description. The scope of the invention includes any other applications in which the above structures are used. Accordingly, the scope of the invention should only be determined with reference to the appended claims, along with the full scope of equivalents to which such claims are entitled.

For example, all of the above-described printers 100 to 500 are constituted so as to interlock either the body gears 113 or the drum gears 151A together with the operation of the front opening 111D being opened and closed. However, these gears may be interlocked when electric power is supplied to the printer, and the interlock may be disengaged when the electric power supply is cut off.

What is claimed is:

1. An image forming apparatus comprising:

an image carrier unit integrally having plural image carriers that respectively carry images, and respectively have rotational shafts;

a unit containing portion that removably contains the image carrier unit;

a plurality of driving units, each of the driving units including at least one driving gear, the at least one driving gear transmitting driving force to the rotational shaft of a corresponding one of the image carriers;

plural driving sources that apply the driving force to the driving gears of the driving units; and a phase change matching unit that matches phase changes in the driving gears of the driving units when no image is formed.

2. The image forming apparatus as set forth in claim 1, wherein the at least one driving gear in each of the driving units comprises a pair of driving gears including a first gear disposed in the image carrier unit, and connected to the rotational shaft of the corresponding one of the image carriers; and a second gear disposed in the unit containing portion, and engaged with the first gear that corresponds thereto, and wherein the phase change matching unit matches the phase changes of all the first gears, when no image is formed.

3. The image forming apparatus as set forth in claim 1, wherein the at least one driving gear in each of the driving units comprises a pair of driving gears including:

a first gear disposed in the image carrier unit, and connected to the rotational shaft of the corresponding one of the image carriers; and a second gear disposed in the unit containing portion, and engaged with the first gear that corresponds thereto, and wherein the phase change matching unit matches the phase changes of all the second gears, when no image is formed.

4. The image forming apparatus as set forth in claim 1, wherein the image carriers are aligned along one direction, wherein the rotational shafts are disposed in parallel to each other, and wherein the driving units are disposed along an alignment direction of the image carriers.

5. The image forming apparatus as set forth in claim 4, wherein at least one of the driving units is an unconnected driving unit having an unconnected driving gear that is unconnected to the driving gears of at least one of driving units that are adjacent to the unconnected driving unit, and wherein the phase change matching unit is constituted so as to dispose an interlock gear between the unconnected driving unit and the driving unit disposed adjacent to the unconnected driving unit so as to interlock the driving gears of the driving units, when no image is formed.

6. The image forming apparatus as set forth in claim 5, further comprising at least one pair of idle gears disposed so as to be separated from each other between the unconnected driving gear of the unconnected driving unit and the driving gear of the driving unit disposed adjacent to the unconnected driving unit, each of the idle gears being engaged with a corresponding one of the driving gears, wherein the phase change matching unit is constituted so as to dispose an interlock gear between the pair of idle gears so as to interlock the unconnected driving gears by the interlock gear, when no image is formed.

7. The image forming apparatus as set forth in claim 5, wherein the phase change matching unit is constituted so as to remove the interlock gears from between the unconnected driving gear of the unconnected driving unit and the driving gear of the driving unit disposed adjacent to the unconnected driving unit, when an image is formed.

8. The image forming apparatus as set forth in claim 7, further comprising an open/close unit that opens/closes the unit containing portion, wherein the phase change matching unit is constituted so as to interlock the unconnected driving gear of the unconnected driving unit and the driving gear of the driving unit disposed adjacent to the unconnected driving unit by the interlock gear in correspondence with the unit containing portion being opened by the open/close unit, and remove the interlock gear from between the unconnected driving gear of the unconnected driving unit and the driving gear of the driving unit disposed adjacent to the unconnected driving unit in correspondence with the unit containing portion being closed by the open/close unit.

9. The image forming apparatus as set forth in claim 4, wherein the unit containing portion is constituted so as to remove the image carrier unit along an alignment direction of the image carriers.

10. The image forming apparatus as set forth in claim 1, wherein the image carrier unit comprises four of the image carriers disposed along one direction, the four image carriers being disposed such that the rotational shafts are disposed in parallel to one another, wherein the unit containing portion is constituted so as to remove the image carrier unit along an alignment direction of the four image carriers, wherein the image forming apparatus comprises:

four of the driving units disposed along the alignment direction of the four image carriers, each of the four driving units including one pair of driving gears having a first gear disposed in the image carrier unit and connected to the rotational shaft of the corresponding one of the image carriers, and a second gear disposed in the unit containing portion and engaged with the first gear that corresponds to the second gear, and two of the driving sources, respectively connected to two of the second gears disposed adjacent to each other in an upstream side of a removal direction of the image carrier unit, and to two of the second gears disposed adjacent to each other in a downstream side, and wherein the phase change matching unit interlocks the second gear, disposed second from the upstream side of the removal direction, and the third gear, disposed third from the upstream side, via an interlock gear.

11. The image forming apparatus as set forth in claim 1, wherein the image carriers respectively carry images in predetermined colors.

12. An image carrier unit comprising:

plural image carriers that respectively carry images, and have rotational shafts;

a housing that integrally supports the image carriers;

a plurality of gears respectively connected to the rotational shafts; and a phase change matching unit that matches phase changes of the gears in response to a condition in which no image is formed.

13. The image carrier unit as set forth in claim 12, wherein the image carriers are aligned along one direction, and wherein the rotational shafts are disposed in parallel to each other.

14. The image carrier unit as set forth in claim 12, wherein the image carriers respectively carry images in predetermined colors.

* * * * *